US005467118A

United States Patent [19]

Gragg et al.

[11] Patent Number: 5,467,118

[45] Date of Patent: Nov. 14, 1995

[54] INK CARTRIDGE FOR A HARD COPY PRINTING OR PLOTTING APPARATUS

[75] Inventors: Brian D. Gragg, San Diego, Calif.; James E. Clark, Albany, Oreg.

[73] Assignee: Hewlett-Packard Company, Palo Alto, Calif.

[21] Appl. No.: 170,840

[22] Filed: Dec. 21, 1993

[51] Int. Cl.[6] ..... B41J 2/175

[52] U.S. Cl. ..... 347/87

[58] Field of Search ..... 347/86, 87; B41J 2/175

[56] References Cited

U.S. PATENT DOCUMENTS 5,025,271 6/1991 Baker et al. ..... 347/87

FOREIGN PATENT DOCUMENTS 561051 9/1993 European Pat. Off. ..... B41J 2/175

*Primary Examiner*—Benjamin R. Fuller
*Assistant Examiner*—Alrick Bobb

[57] ABSTRACT

An improved pen for a hard copy printing device. Reservoirs within the central chamber of an ink cartridge housing are sealingly coupled to individual ink channels connecting each reservoir individually and directly to an exterior surface of the cartridge housing. An ink filter, downstream of any ink contaminating features of the construction, is also provided.

7 Claims, 7 Drawing Sheets

INK CARTRIDGE FOR A HARD COPY PRINTING OR PLOTTING APPARATUS

BACKGROUND OF THE INVENTION

1. Field of the Invention

The present invention relates generally to hard copy printing devices, such as computer printers and plotters, fax machines, and the like, more particularly, to ink-jet type ink cartridge devices, and, more specifically, to an improved ink-jet cartridge for a thermal ink-jet pen.

2. Description of the Related Art

The art of thermal ink-jet printing is relatively well-developed. The basics are disclosed, for example, in various articles in the *Hewlett-Packard Journal,* May 1985, August 1988, October 1988, August 1992, and December 1992 editions, incorporated herein by reference.

In the art, it is known to provide a scanning printhead having a nozzle plate in combination with heating elements. Thermal excitation of ink is used to eject droplets through tiny nozzles, or "orifices," onto a print media. The nozzle plate configuration is one of the design factors that controls droplet size, velocity and trajectory of the droplets. The state-of-the-art has progressed to the state where ink-jet printers provide near-laser print quality by providing resolution up to 1200 dots per inch ("dpi").

Another important design factor in thermal ink-jet technology is the storage and delivery of ink from a reservoir to the nozzle plate of the printhead. In general, problems of fluid dynamics, ink containment, handling and leakage, ink mixing in multi-reservoir pens, printhead clogging due to ink supply contamination, air ingestion and entrapment, pen priming, printhead back pressure, and others are of major concern to those skilled in the art.

Various types of ink reservoirs have been used, including both disposable and refillable ink reservoir cartridges. In one type, the reservoir is integrated with the pen and mounted on a moveable printer carriage for scanning across the print media. In another, a remote, or "off-board," ink reservoir is provided from which ink is drawn to the printhead through a tubing system. The latter is demonstrated, for example, in U.S. Pat. No. 4,422,084, (Saito) in FIGS. 2 and 3, labeled "Prior Art." It has been found in general that the relatively long tubing used to convey ink from an off-board reservoir to a printhead does not lend itself well for different printing pressure ranges. Such complicated systems exacerbate the problems associated with delivery of ink from a reservoir to a printhead.

Several designs and features of integrated pens are disclosed by the common assignee of the present application in the following co-pending applications, incorporated herein by reference:

- NEGATIVE PRESSURE INK DELIVERY SYSTEM, Ser. No. 07/995,851, filed Dec. 23, 1992, (Kaplinsky, et al.); abandoned
- COMPACT FLUID COUPLER FOR THERMAL INK JET PRINT CARTRIDGE AND RESERVOIR, Ser. No. 07/853,372, filed Mar. 18, 1992, (Salter);
- INK PRESSURE REGULATOR FOR A THERMAL INK-JET PRINTER, Ser. No. 07/928,811, filed Aug. 12, 1992, (Khodapanah et al.);
- TWO MATERIAL FRAME HAVING DISSIMILAR PROPERTIES FOR A THERMAL INK-JET CARTRIDGE, Ser. No. 07/994,807, filed Aug. 12, 1992, (Swanson et al.);

- RIGID LOOP CASE STRUCTURE FOR THERMAL INK-JET PEN, Ser. No. 07/994,808, filed Dec. 22, 1992, (Swanson et al.);
- THERMAL INK-JET PEN WITH A PLASTIC/METAL ATTACHMENT FOR THE COVER, Ser. No. 07/994,810, filed Aug. 12, 1992, (Timm et al.);
- THIN PEN STRUCTURE FOR THERMAL INK-JET PRINTER, Ser. No. 07/994,809, filed Dec. 22, 1992, (Swanson et al.);
- DOUBLE COMPARTMENT INK-JET CARTRIDGE WITH OPTIMUM SNOUT, Ser. No. 07/995,221, filed Dec. 22, 1992, (Swanson et al.);
- LAMINATED FILM INK RESERVOIR, Ser. No. 07/995,868, filed Dec. 23, 1992, (Scheffelin);
- TWO MATERIAL FRAME HAVING DISSIMILAR PROPERTIES FOR THERMAL INK-JET CARTRIDGE, Ser. No. 08/058,730, filed May 3, 1993, (Chundury);
- SPRING BAG PRINTER INK CARTRIDGE WITH VOLUME INDICATOR, Ser. No. 07/717,735, filed Jun. 19, 1991, (Hunt et al.); U.S. Pat. No. 5,359,353, and
- PRINTER INK CARTRIDGE, Ser. No. 08/170951, (Gragg, et al.), filed concurrently herewith.

There is a need to provide an ink cartridge which reliably delivers a steady flow of liquid ink to the printhead but which is capable of withstanding the rigors of high-speed computer printing operations and the design problems associated with high-speed scanning of a pen across the print media.

SUMMARY OF THE INVENTION

In its broad aspect, the present invention provides a fitment apparatus for supplying independent outflow of ink from each said reservoir to said printhead device, including at least two fixtures, unitary with a cartridge and extending into separate ink reservoir chambers, for piping ink from said reservoirs to a printhead device, and a structure for forming inner walls of said reservoirs, within said chamber, forming a substantially fluid-tight seal between each said structure and said fixtures respectively, such that ink in each said reservoir can flow out through only one said fixtures to said printhead device.

It is an advantage of the present invention that it provides an improved, compact design for computer-driven printer, or plotter, pen ink cartridges.

It is an advantage of the present invention in that it substantially eliminates the problem of inadvertent mixing of different colorants in a multi-reservoir ink pen.

It is another advantage of the present invention that the construction disclosed causes less contamination of the printhead mechanism from the ink reservoir portion of the pen.

It is yet another advantage of the present invention that it provides a substantially leakproof interface between a multi-reservoir ink cartridge and its associated printhead.

It is a further advantage of the present invention that it is manufacturable by simple and inexpensive plastic injection molding techniques and sonic or heat-tack welding of plastic parts.

It is still another advantage of the present invention that it provides a design that is adaptable to both single and multiple ink reservoir chamber pens.

Yet another advantage of the present invention is that it provides a substantially leakproof fitment between an ink reservoir and a printhead.

It is still another advantage of the present invention to increase the internal ink volume of a pen cartridge.

Another advantage of the present invention is to provide a structure that creates a low pressure drop across an ink filter in order to maintain a required ink flow rate.

Other objects, features and advantages of the present invention will become apparent upon consideration of the following detailed description and the accompanying drawings, in which like reference designations represent like features throughout the FIGURES.

BRIEF DESCRIPTION OF THE DRAWINGS

FIGS. 1A and 1B depict the present invention in two views in which:

FIG. 1A is a perspective view of the assembled ink reservoir cartridge of the present invention from an angle showing a cartridge snout device having multiple ink discharge ports; and FIG. 1B is a perspective view of the assembled ink reservoir cartridge of the present invention as shown in FIG. 1A from a reverse angle.

FIGS. 3A and 3B depict components of the present invention as shown in FIG. 2 in which:

FIG. 3A is a perspective view of an inner frame of the ink reservoir cartridge of present invention as shown in FIG. 1; and FIG. 3B is a perspectivie view cross-section of the inner frame as shown in FIG. 3A along line 3B.

FIGS. 4A and 4B depict components of the present invention as shown in FIGS. 2 and 3 in which:

FIG. 4A is a perspective view of the assembled outer reservoir housing and inner frame; and FIG. 4B is a perspective view of the assembled outer reservoir housing and inner frame as shown in FIG. 4A from a reverse angle.

FIGS. 5A and 5B depict a device of the present invention in two views in which:

FIG. 5A is a view of an external snout device of the present invention as shown in FIG. 1; and FIG. 5B is a perspective view of the device as shown in FIG. 5A from a reverse angle.

The drawings referred to in this description should be understood as not being drawn to scale except if specifically noted.

DETAILED DESCRIPTION OF THE INVENTION

Figure 1B:
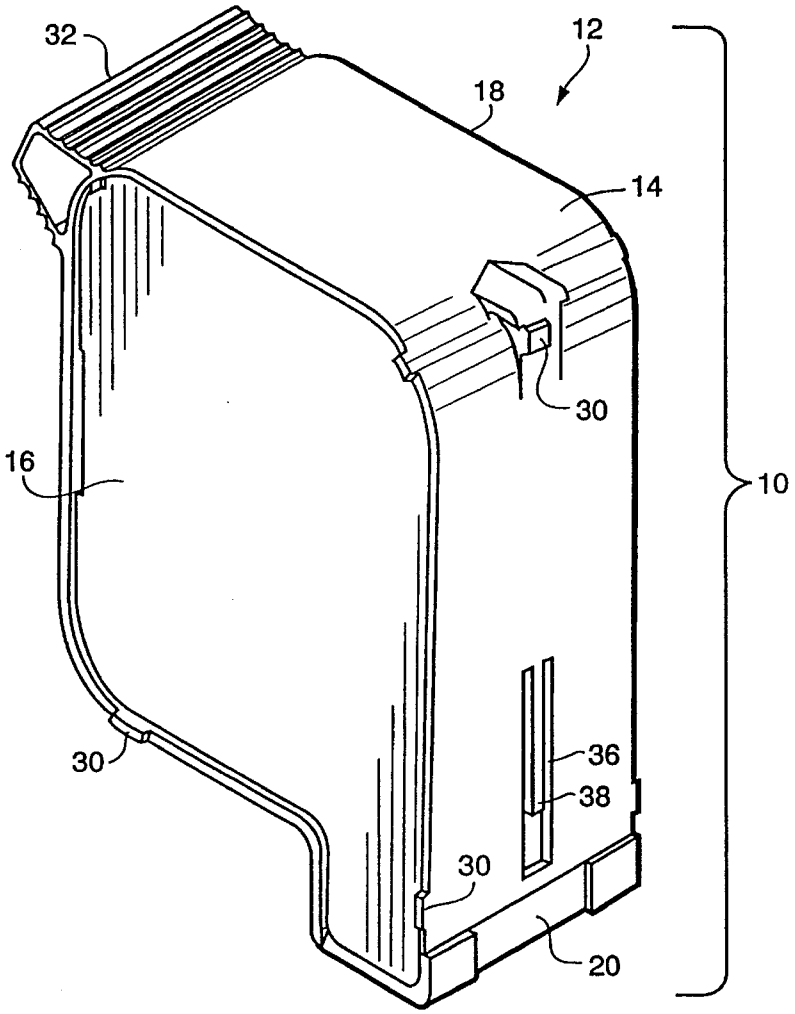
Figure 1A:
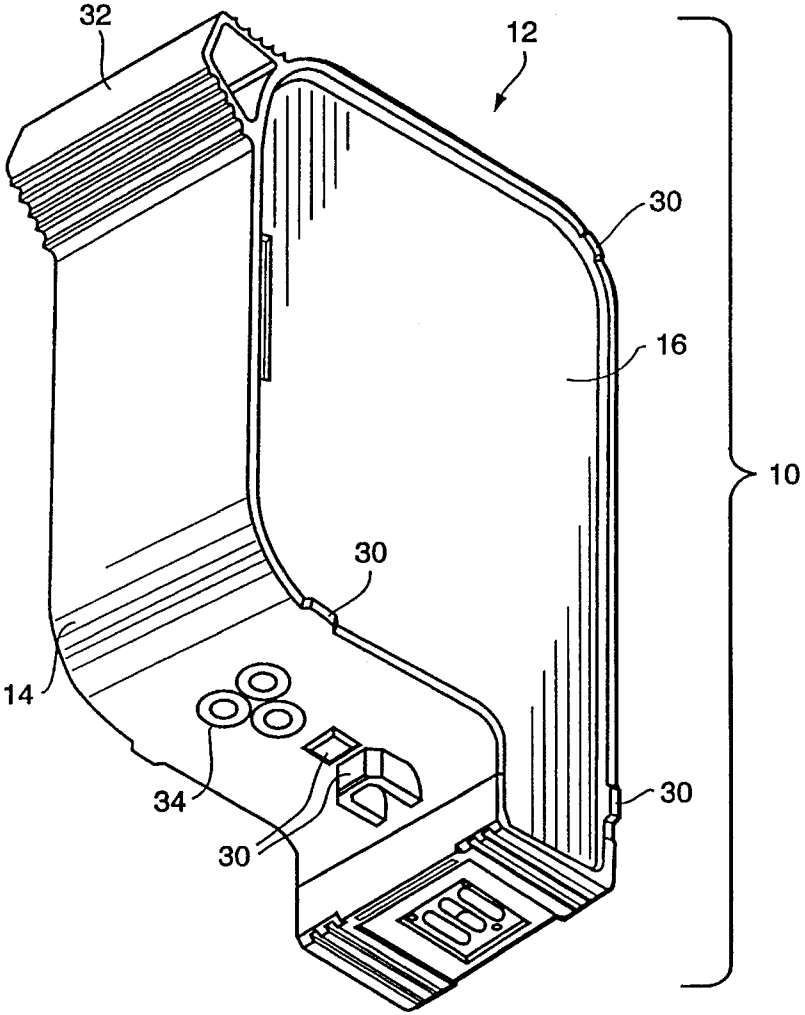

Reference is made now in detail to a specific embodiment of the present invention, which illustrates the best mode presently contemplated by the inventor(s) for practicing the invention. Alternative embodiments and applications of use within the field are also briefly described as applicable. Referring to FIGS. 1A and 1B, an ink-jet pen cartridge 10 of the present invention is depicted in its fully assembled condition, that is, it is prepared for the mounting of a thermal ink-jet printhead assembly (not shown). In the fully assembled condition, the apparatus is sometimes referred to in the art as "the pen."

In the preferred embodiment, an outer housing 12 has three members, a peripheral wall member 14 and two cover plates 16, 18, which when assembled form an enclosed central chamber 50. The housing peripheral wall member 14 is formed, such as by injection molding, of a relatively rigid plastic, such as a glass-filled, modified polyphenylene oxide, polysulfone, or other appropriate plastic. One appropriate plastic material is available in the market; for example, the Plastics Group of General Electric Company manufactures such a product under the trademark "NORYL." In an embodiment in which the cover plates 16, 18 do not need to provide a fluid type seal with the peripheral wall member 14, they are made from sheet metal. Sheet metal, being thinner than a plastic equivalent will provide additional ink reservoir space within the cartridge outer housing 12.

The cartridge 10 further includes an external snout device 20 which is mounted upon outer housing 12 in a manner such that the fitment provides a fluid-tight seal (or "weld"). Mounting external snout device 20 externally of the reservoir containment housing has been found to provide several advantages as set forth above.

It should be noted that because the snout device 20 is mounted externally to the outer housing peripheral wall 14, those skilled in the art will recognize that the cartridge housing 12 itself (and its internal mechanisms disclosed hereinafter) is readily adaptable to other uses, such as in guided wire dot matrix printers and piezoelectric drive ink-jet printers. In other words, the external snout 20 can be readily modified to accommodate not only various ink-jet printheads, but also printheads of other types.

In the field of ink-jet printing, characters and figures formed on the print media are formed of contiguous microscopic dots of ink that are shot across a very small gap between the scanning printhead and print media. Therefore, it is critical that the pen be accurately aligned on a carriage that will scan the printhead across the print media. The cartridge 10 is thus formed with predetermined alignment datum features 30 to register the cartridge 10 in a printer carriage mechanism (not shown). The positioning of such datum features 30 will depend upon the carriage mechanism designed to hold the cartridge 10. Datums can also be provided for alignment with an adjacent pen mounted in the same pen carriage mechanism.

In order to make the cartridge more easy to insert and remove from a carriage mechanism, an optional user handle 32 may also be provided as part of the outer housing 12.

As is known in the art, a sealable reservoir-filling port 34 is provided for injecting ink into the reservoir device, for example, a foam block or an ink bag (not shown) within the cartridge housing 12. In a color pen, there are generally three reservoir devices, such as those disclosed in the co-pending, continuation-in-part, patent application, Ser. No. 08/170951, by Gragg as referenced and incorporated above.

Another feature of the outer housing 12 that is dependent upon the printer apparatus to which the cartridge 10 is to be adapted is the printhead circuit mounting slot 36 shown with a preformed central tab member 38 as shown in FIG. 1B. Such slots are known to reduce the effect of molding sink on the surface around the slot and to provide a proper electrical interconnect between the printhead and the printer electronics.

Figure 2:
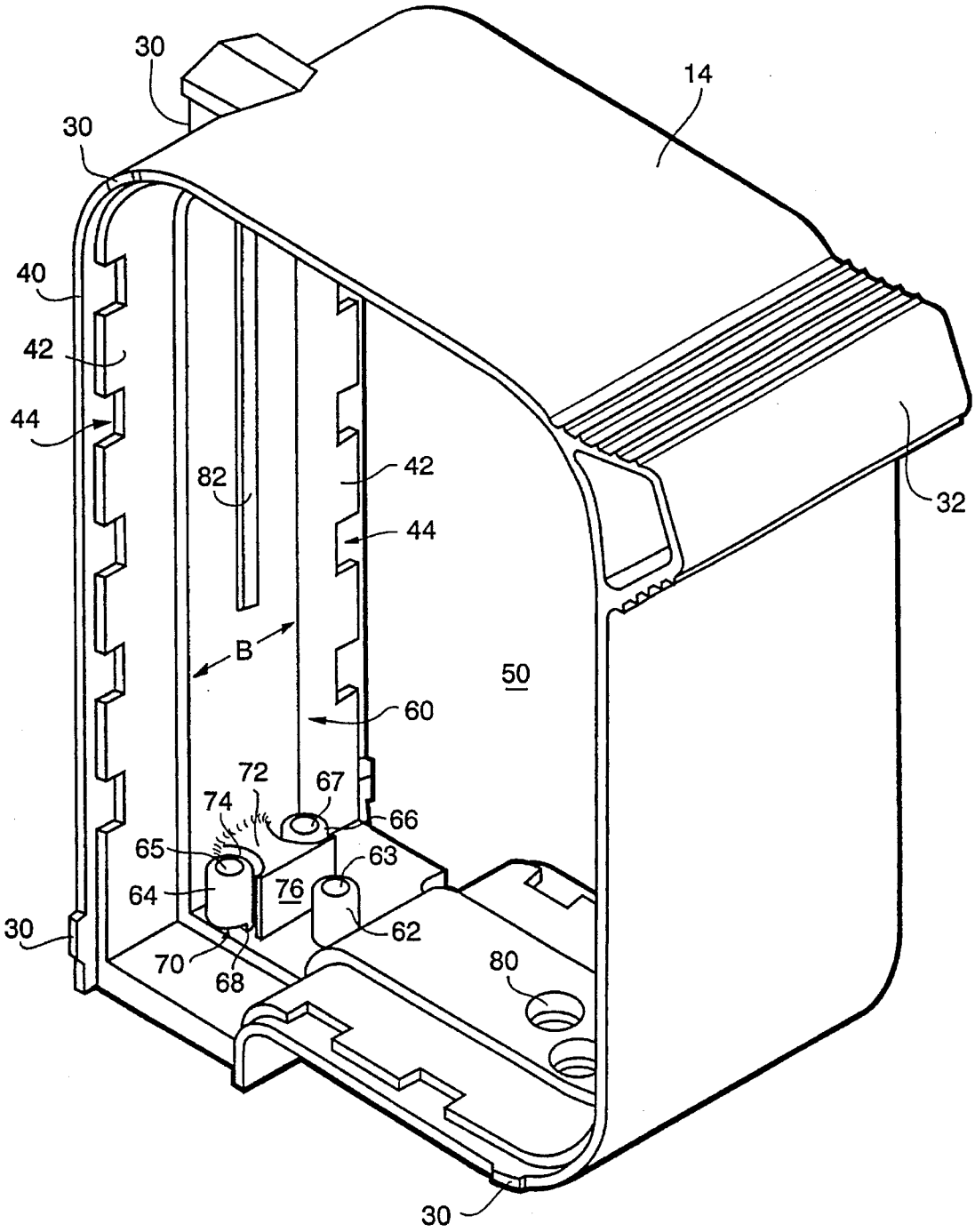
FIG. 2 is a perspective view of an ink cartridge reservoir outer housing of the present invention as shown in FIG. 1.

Referring now to FIG. 2, outer housing peripheral wall 14 is shown in detail with the cover plates 16, 18 and the external snout device 20 removed. A relatively large central chamber 50 is formed by the peripheral wall 14.

As is known in the art, the outer housing peripheral wall 14 may be formed in the first shot of a two-shot injection molding process with all of the features to be described hereinafter being formed by the molding process. The present embodiment is described for a cartridge adapted to be used in full color printing. Such an embodiment is used, for example, in color printer applications which generally use three colorants—such as yellow, magenta, and cyan colorants—to create a full range of print color combinations. The specific features described and depicted are not intended to be a limitation on the scope of the invention. It will be recognized by a person of rudimentary skill in the art that these features are dependent upon the application. For example, such cartridges are often used in tandem, located side-by-side in a printer carriage, with one cartridge containing three color inks and the other containing black ink. Such systems provide both ordinary text font and full color plotting capabilities for the user. While a three reservoir compartment will be described herein, only slight modifications will be recognized as making the invention adaptable to other variations, for example, a one-compartment black ink cartridge, a two-compartment black and red ink cartridge, or a combined black ink and three color ink four-compartment cartridge.

Internally of the peripheral wall 14, having an outer edge 40 outer edges have stepped tongue-and-groove sections 42, 44. Several adaptations will be evident to those skilled in the art. In the present embodiment, the cover plates 16, 18 are made with protrusions (not shown) in order to mate appropriately with the tongue-and-groove sections 42, 44 of outer housing 12. Depending upon the type of ink reservoir to be encapsulated within the outer housing 12, the mating design may be adapted to form a fluid-tight seal. For example, if the ink reservoir is of a sealed bag type, the fit may not need to be fluid-tight, but if the reservoir is of a saturated-foam type, a fluid-tight seal may be appropriate and the cover plates 16, 18 may be formed of a plastic material accordingly.

A raised-step inner section 60 that runs completely around the inner surface of the peripheral wall 14 is located approximately centrally to the interior chamber 50. In the present embodiment, this circumferential, raised-step, inner section 60 is designed for use with three collapsible membrane reservoir bags (not shown) such as is disclosed in co-pending application Ser. No. 08/170,951, (Gragg), referenced and incorporated above.

Three ink pipes 62, 64, 66, one for each reservoir, extending into the chamber 50 from the raised-step inner section 60 are provided. Each ink pipe 62, 64, 66 has a central bore 63, 65, 67, respectively, with the bore holes of each extending from the interior chamber 50, as an ink inlet port, through the peripheral wall 14 to become an ink outlet port. As explained in more detail below, the ink pipes 62, 64, 66 will be in fluid communication with the snout device 20. At the base 68 of each ink pipe stem is an indentation 70 or "notch." A wedge section 72 of the raised-step inner section 60 protrudes inwardly from the raised-step inner section 60 into the chamber 50, separating the ink pipes 62, 64, 66. The wedge section 72 has walls oriented perpendicularly to the raised step, located on the raised step section 60 slightly spaced from the ink pipes 62, 64, 66: two curved sidewalls 74, one each in close proximity to the two ink pipes 64, 66 and a flat wall 76 in close proximity to the third ink pipe 62.

Ink reservoir fill holes 80 extend through the structure. A ridge 82 protrudes into the chamber 50 used for locating in the second-shot molded structure of FIG. 3.

Figure 3A:
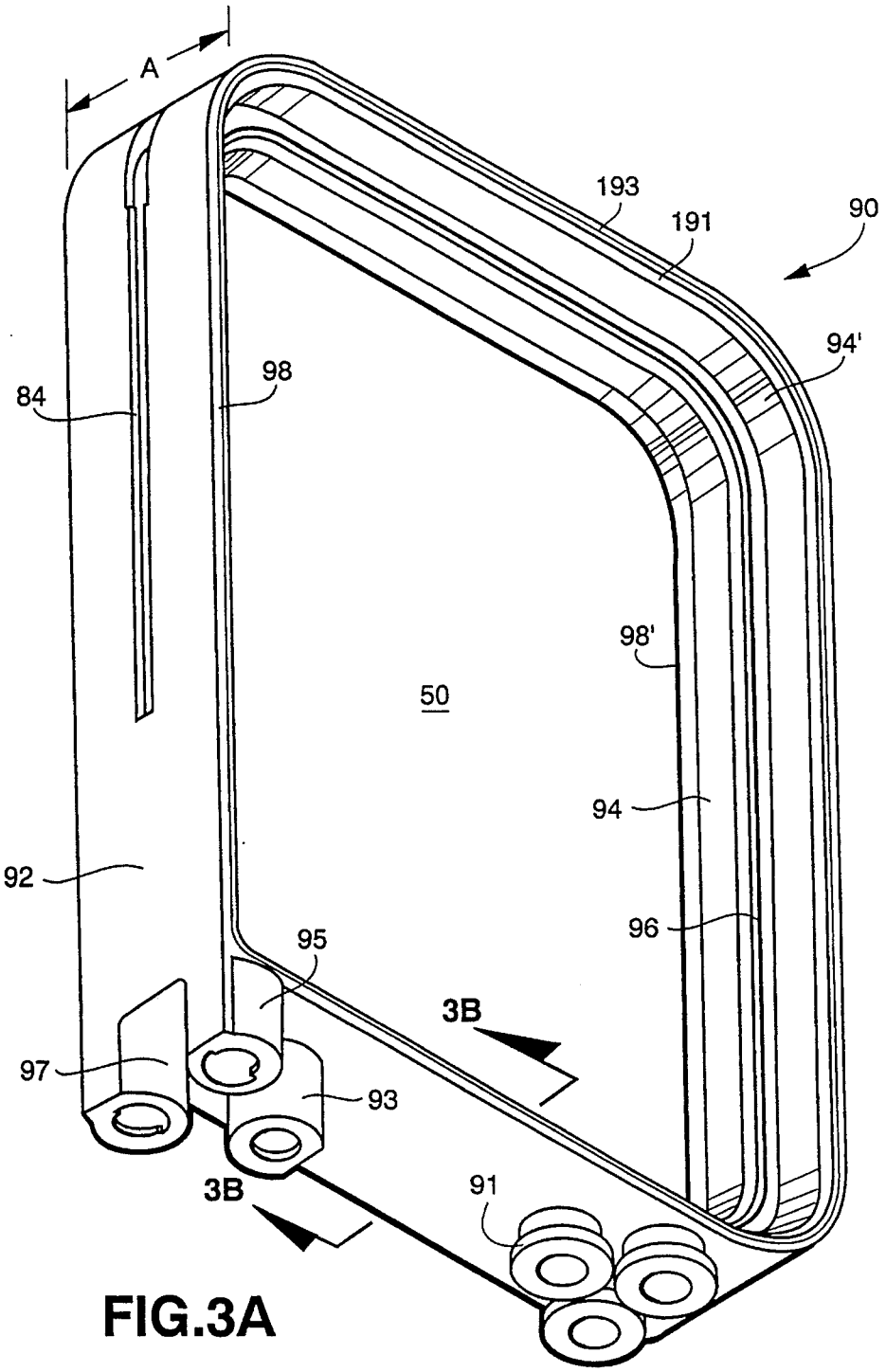

Referring now to FIG. 3A, the second-shot structure of the molded cartridge 12 is depicted without the first-shot peripheral wall 14 of FIG. 2. The second-shot structure comprises an inner frame 90, to be molded upon the inner surface of first-shot raised-step inner section 60 within the central chamber 50 of outer housing 12. Positioning the inner frame 90 in this manner allows the maximization of room within the chamber 50 for providing a substantially equal volume of ink in each reservoir of which the inner frame will form interior walls. The inner frame 90 is formed with protruding, sealable, fill-pipes 91 for insertion into the ink reservoir fill holes 80, one fill-pipe 91 per each fill hole leading from outside the peripheral wall 14 into each reservoir to be contained in the central chamber 50. The inner frame 90 is used for the mounting of three collapsible membrane ink reservoir bags as mentioned above.

The inner frame 90 is generally formed of a softer plastic than the outer housing 12, being molded from a plastic material (for example, high-density polyethylene, polypropylene, nylon, or other appropriate material) to facilitate the attachment of the ink reservoir bags with a liquid tight seal when welded thereon without affecting the plastic of the housing peripheral wall 14 during the assembly process.

Figure 3B:
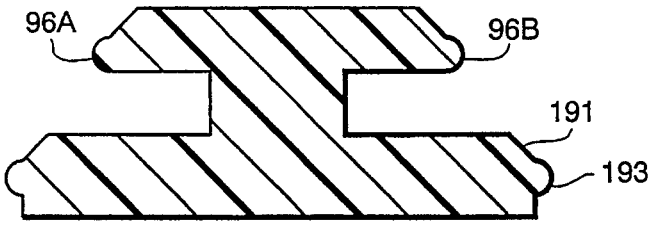

Referring briefly to FIG. 3B, to further facilitate attachment of the reservoir bag membranes, in the preferred embodiment an optional chamfer 191 and a reservoir mounting beads 193 rim the inner frame 90 on each side. It is intended that such beads soften and tack to the reservoir membrane. A similar bead 96A, 96B rims the raised-step inner section 60.

The inner frame 90 abuts the inner surface of the raised-step inner section 60 and includes an outer wall 92, having an alignment groove 84 for accepting ridge 82 of the first-shot molded raised-step inner section 60 accordingly. The cross-dimension— A—of the inner frame 90 is slightly greater than the parallel cross-dimension—B—of the raised-step inner section 60. In this manner, a slight protruding lip on the inner frame 90, overhanging the step, is formed to facilitate the attachment and liquid-tight seal of the ink reservoir bag membranes.

Inner wall 94, 94' of the inner frame 90 also bears an internal, circumferential raised ridge 96 that extends into the central chamber 50. A cross-section as shown in FIG. 3B of the circumferential ridge 96 should be generally a T-shape. An optional bead 96A, 96B rimming the edge of the T may also be provided to similarly facilitate reservoir bag membrane attachment.

Depending from the outer wall 92 of the inner frame 90 are three hollow sleeves 93, 95, 97. The shape and size of the bore of each sleeve is chosen to match in the complement the external circumference and shape and size of the corresponding pipe over which each sleeve is fitted (or, as in the preferred embodiment, molded). Additionally, the sleeves 93, 95, 97 are designed to conform complementarily with, but not touching, the wedge walls 74, 76.

The formed sleeves 93, 95, 97 will shrink onto the pipes during the post-molding cooling period. By doing so, each sleeve 93, 95, 97 will shrink away from the wedge section 72 and the adjacent inner surface of raised-step inner section 60 adjacent the pipes. It will be noted also that in an injection molding process, the plastic flow will fill the notches 70 at each base 68 of the pipes 62, 64, 66 to lock the two materials together. In the alternative, the pipes might be ribbed circumferentially to provide such a locking mechanism.

Generally, it has been found that round pipes and sleeves of a constant thickness are preferable. These factors keep the hoop stress in the sleeves constant allowing for maximum and uniform clamping force between the pipes and sleeves. As ink flow in the assembled pen is greatly affected by capillary action, these features of the present invention may be critical to form liquid tight seals between the ink reservoirs.

As mentioned, in the best case, the seals formed around the ink pipes will be liquid tight. In the event that imperfections in the molding process do not form a perfect seal, the adjoining inner walls of the hollow sleeves and the outer walls of the ink pipes will be tight enough despite any residual gap between them to form a capillary interface between the ink inside the pen and the air outside that is strong enough to keep the ink in the pen. The remaining concern would be to keep the capillaries created from connecting between reservoir chambers as there will be different color inks in each. That is, if a capillary from one pipe meets with a capillary from another, the inks would be able to flow between pipes, contaminating the reservoirs and the printhead. It has been found that a shrink fit of the sleeves over the pipes solves this problem. During post-injection molding cooling, the plastic of the sleeves 93, 95, 97 shrinks away from the adjacent walls of the raised-step inner section 60 and the wedge walls 74, 76, it creates a larger gap than that which may be left between a sleeve and a pipe. As, in capillary flow action, smaller gaps have stronger capillary forces than larger gaps, since the pipe-to-sleeve gap is the smaller, ink will not flow out of it into the larger gap between the sleeve and the adjacent wall or wedge and contamination is prevented.

Figure 4A:
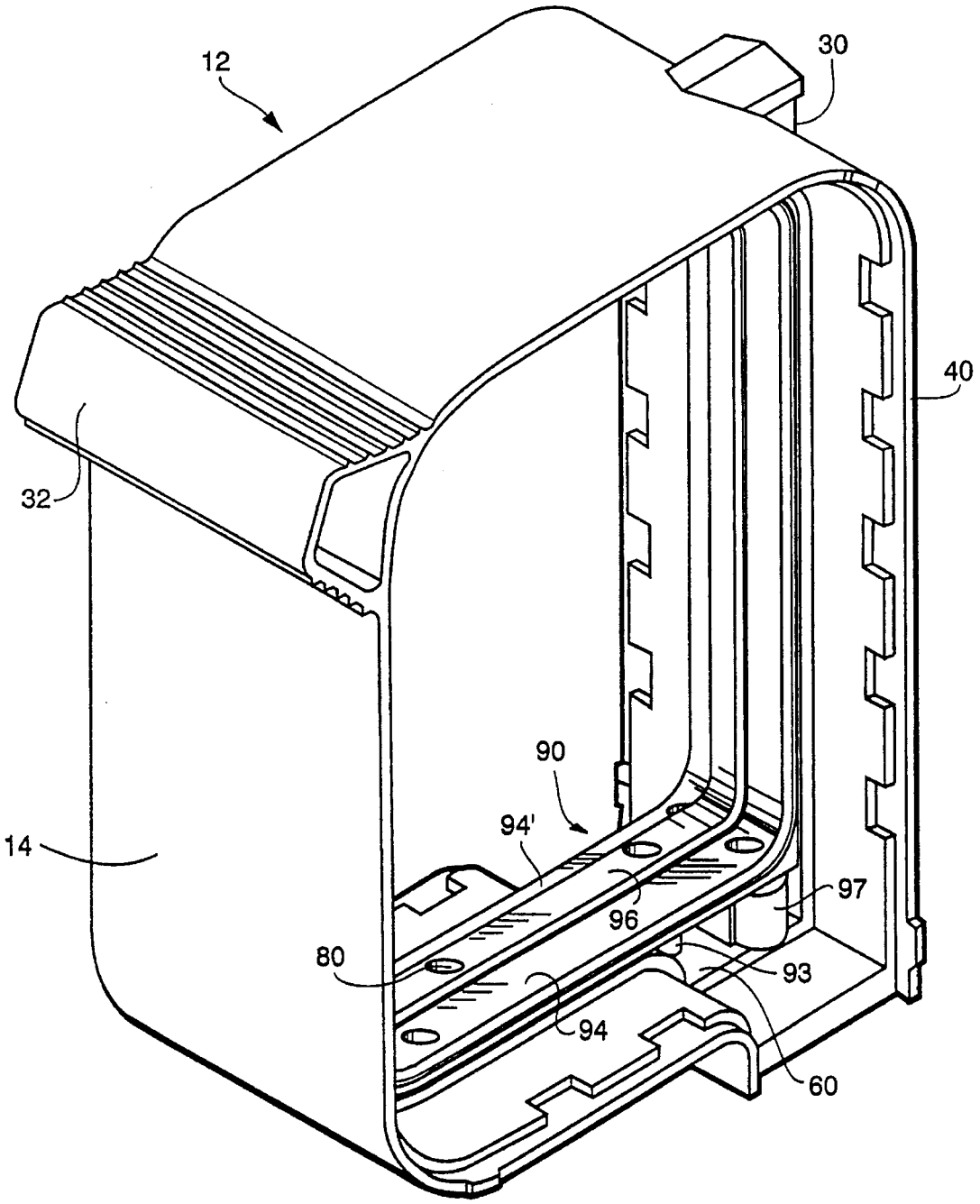
Figure 4B:
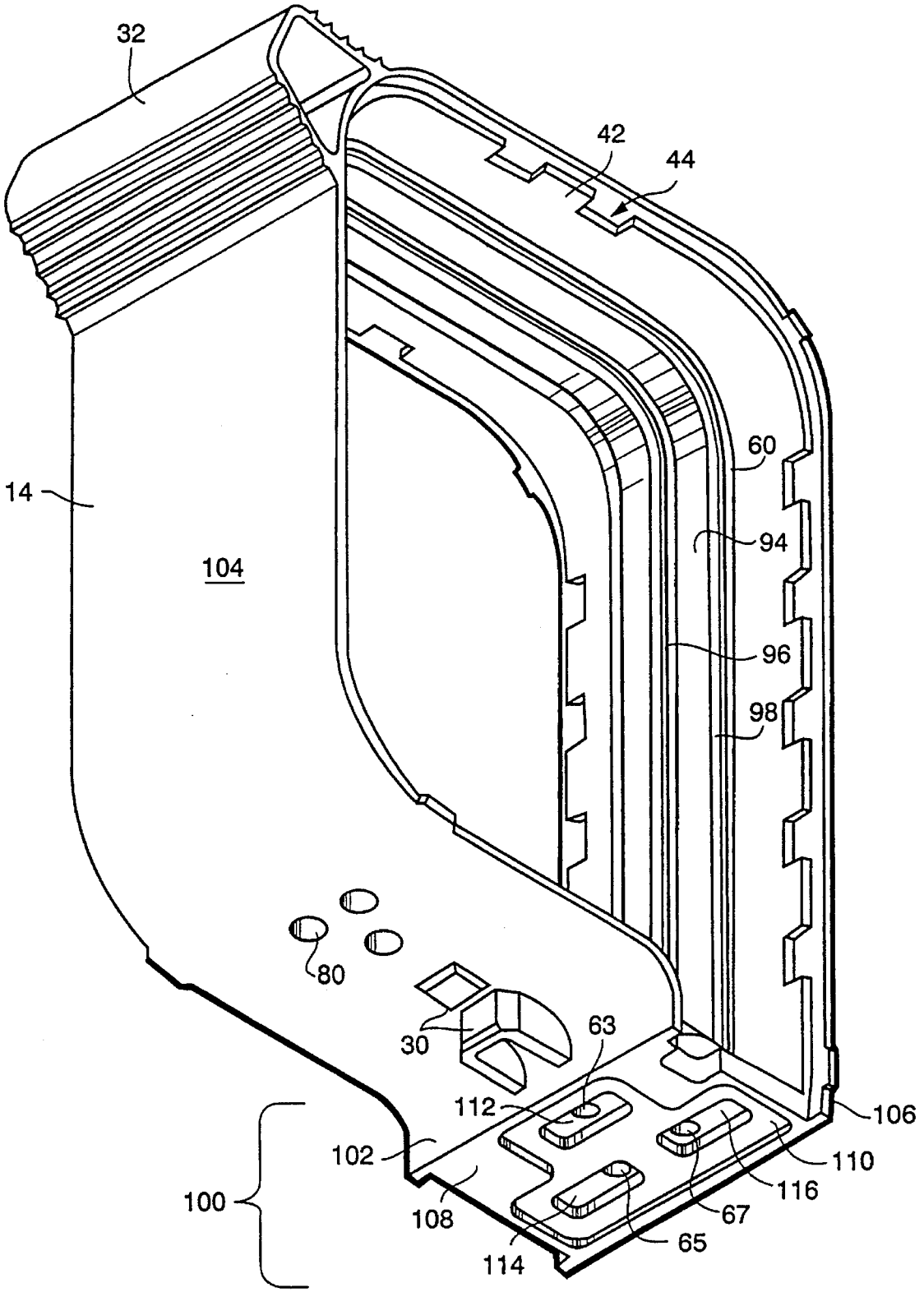

The assembled (or fully molded) outer housing 14 and inner frame 90 is depicted in FIGS. 4A and 4B (again, without the cover plates 16, 18 and the external snout 20). In a three reservoir pen, the two inner membranes (not shown) of the ink reservoir bags are sealed, such as by heat welding, to the T-shaped raised ridge 96, one on each side 96A, 96B, forming a first ink reservoir therebetween. A third membrane is affixed to the bead 193 on the edge 98 of inner frame 90 which, as noted above forms a lip over raised step section 60 of the outer housing 14 within the chamber 50. A fourth membrane is similarly affixed to the bead of the opposite edge 98' of the inner frame 90. In such fashion, three separate reservoirs are formed within the central chamber 50 of outer housing 12. In this construction, each reservoir thus has a fill hole 80 and each reservoir is in fluid communication with only one ink pipe to allow the outflow of ink from a respective reservoir to the snout device 20.

The seals between the inner frame sleeves 93, 95, 97 and the outer housing pipes 62, 64, 66 and of the reservoir bag membranes to the inner frame 90 substantially eliminate any leakage or mixing of the inks within the outer housing 12 or on the passage from a reservoir to the snout device 20.

In an alternative embodiment (not shown), the ink pipes 62, 64, 66 protruding into the chamber 50 are eliminated in the manner of the prior art where only ink outflow ports are provided in an ink cartridge wall where the printhead is normally attached. Inner frame 90 is then formed with the sleeves extending through those outflow ports into communication with the printhead, that is, in the same manner as the ink-fill pipes 91 lead from each reservoir to the external face of outer housing peripheral wall 14. That is, the sleeves have now become ink pipes extending through the cartridge peripheral wall 14 at a printhead mounting external surface area of the wall 14. In such an embodiment, it will be useful to flange the inner frame plastic material outwardly from the ink outflow port to form a gasket on the printhead side of the housing 12 in order to eliminate leakage, ink mixing, and the like problems.

Referring to FIG. 4B, focus is drawn to the snout device 20 mount portion 100 of the outer surface of the peripheral wall 14 of the outer housing 12. At the region of the peripheral wall 14 where the snout device 20 is to be mounted, peripheral wall 14 bends downwardly to form a relatively short peripheral wall section 102 that is substantially parallel to peripheral wall 14 section 104 and opposite peripheral wall section 106. Peripheral wall 14 continues perpendicularly between the two opposing parallel wall sections 102, 106 to join them as a relatively short, substantially flat, snout mount surface 108. A first recess area 110 is formed in mount surface 108 that encompasses the ink outlet side of all three of the ink pipe bores 63, 65, 67. Within the first recess area 110 are three deeper recesses 112, 114, 116, aligned respectively with only one each of the downstream bore ink outlet ports of the three ink pipes 62, 64, 66.

Figure 5A:
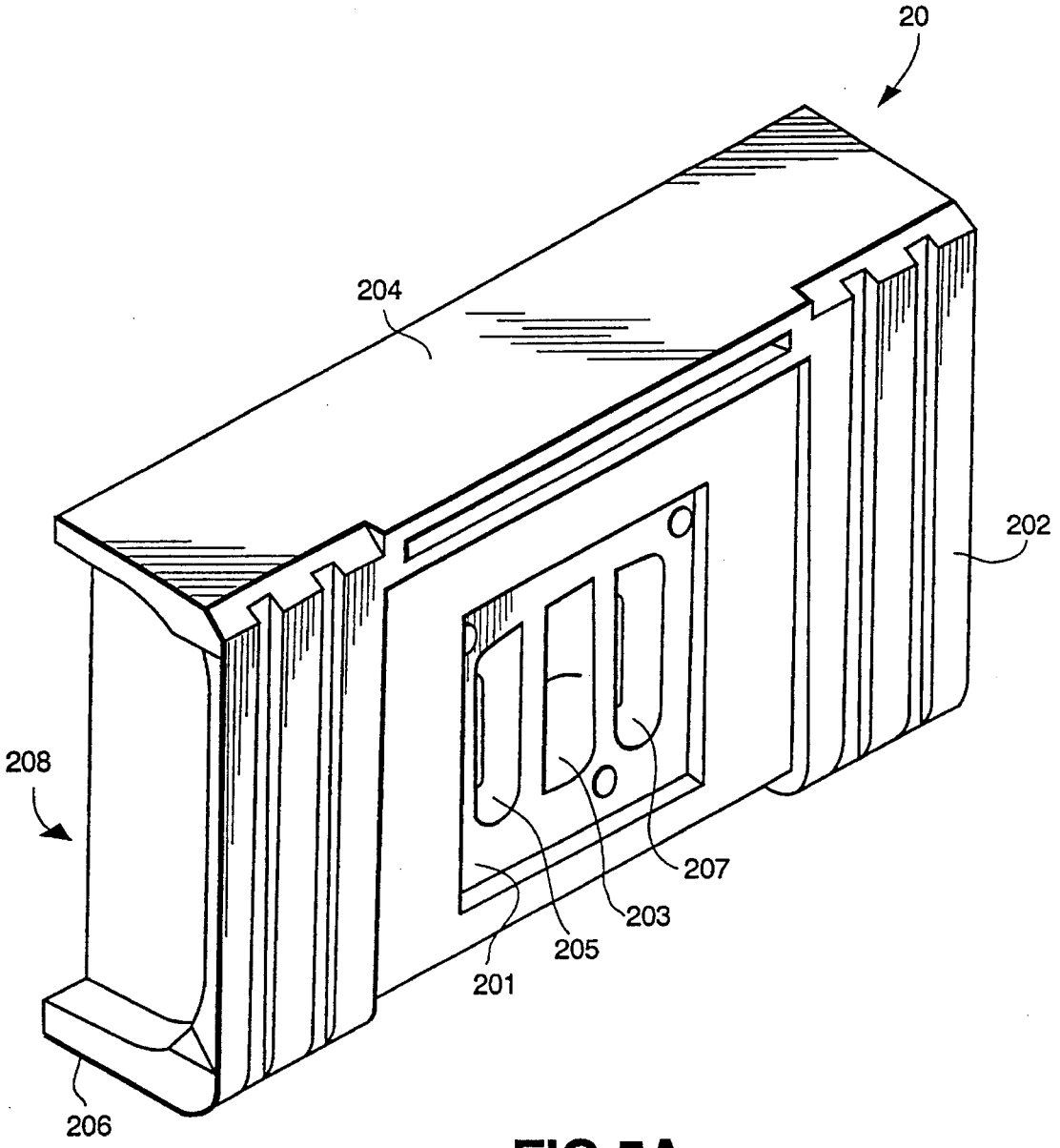
Figure 5B:
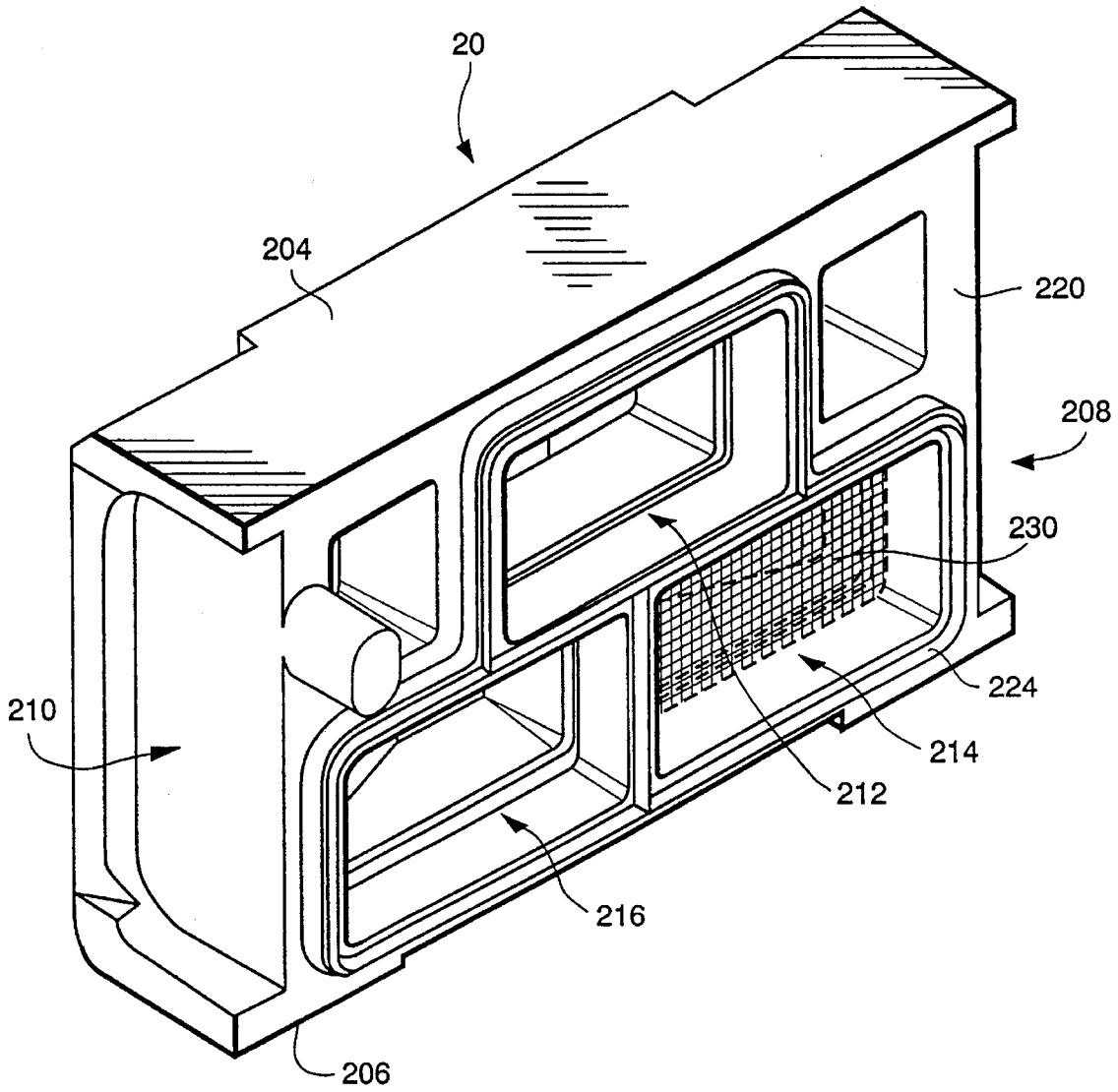

The external snout device 20 is shown in FIGS. 5A and 5B. In general, the snout device 20 is molded from a plastic, such as NORYL, that can be sealingly mounted (such as by ultrasonic welding, fusion bonding, gluing, or other well-known techniques that would not affect the structural integrity of the outer housing frame 12) onto the outer housing frame 12 in the first recess area 110 in order to separate the fluid paths through the snout device 20.

FIG. 5A shows the external face of the snout 202. It will be understood by a person skilled in the art that the features of the face 202 will conform to the TAB circuit orifice plate (not shown) to be mounted thereon. Two external walls 204, 206 of the snout device 20 are generally flat surfaces abutting along the weld with wall sections 102, 106 of the housing 12. Recesses 208, 210 are provided to fit the snout 20 to the cover plates 16, 18 (as shown in FIGS. 1A and 1B, respectively). In the present embodiment, a recess 201 and three snout face apertures 203, 205, 207 are provided for feeding ink from the reservoirs within the cartridge inner chamber 50 to the printhead mechanism.

Referring now to FIG. 5B, a substantially flat surface 220 of the snout is provided to abut the snout mount surface 108 of the outer housing 12 (as shown in FIG. 4B). A protruding ridge 224, rising up from the flat surface 220, is of the same peripheral shape as the first recess 110 in mount surface 108 for mating the two parts with the ridge 224 entering the first recess 110. Three snout recesses 212, 214, 216, each of which are aligned with and encompass the three deeper recesses 112, 114, 116, respectively, of the snout mount surface 108 within the first recess 110. Thus, when the snout device 20 is welded in place on the recess area surface 110 of the outer housing 12, three continuous ink outflow channels have been formed from the inner chamber 50 reservoir sections, through the ink pipe bores 63, 65, 67, into the three deeper recesses 112, 114, 116 of the first recess 110, directly into the three aligned snout device recesses 212, 214, 216 that then funnel ink to respective snout face apertures 203,205, 207.

In the preferred embodiment, a form-fit ink filter (230), such as a fine mesh screen, is provided in each snout recess 212, 214, 216. Such filters 230 are described in co-pending application Ser. No. 07/995,109, (Kaplinsky) referenced and incorporated above. Mounting the filter 230 at this point in the ink outflow channel provides certain advantages.

The primary purpose of the filter 230 is to prevent air bubbles (from the reservoir into the printhead or from the printhead up into the reservoir) from interrupting the operation of the pen and to prevent particulate contamination to the printhead from the ink reservoir. Such filters 230 have generally been located somewhere Within the reservoir of a pen. For example, in a foam-based reservoir, the filter 230 is usually in direct contact with the foam. However, as will be recognized in the present invention, the filter 230 is now located downstream not only of the reservoir but also of all mechanical features (such as where ultrasonic weld points are formed or from elastomers, adhesives, or the like that may be used during pen assembly) that can contribute particulate contamination of the printhead. In other words, all parts and weld or glue points of parts in the present embodiment are upstream of the filter 230 with respect to ink outflow to the printhead. Therefore, for example, virtually any and all contaminants, such as minute pieces of plastic introduced into a reservoir during the pen assembly procedures and the ink filling process, will be trapped by the downstream filter 230 in the external snout device 20.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. In a pen for a hard copy printing device, having an ink cartridge with an exterior surface, an inner surface, and an interior cartridge chamber containing at least two ink reservoirs, each of said reservoirs having a supply of ink therein, and a printhead device on said exterior surface, a fitment apparatus for supplying independent outflow of ink from each of said reservoirs to said printhead device, comprising:

at least two means, unitary with said cartridge and extending into said chamber, for piping ink from each of said reservoirs respectively to said printhead device;

a unitary means for forming inner walls of both of said reservoirs, having a means thereon for forming a substantially fluid-tight seal between said unitary means and each of said means for piping ink respectively, such that ink in each of said reservoirs can flow out through only one of said means for piping;

means for filtering said outflow of ink from said reservoirs; and means, bonded to said cartridge in a substantially fluid-tight seal between said cartridge and said printhead device, for holding said means for filtering said outflow of ink, wherein each of said means for piping ink is a tubular pipe device, extending inwardly from said inner surface of said cartridge into said chamber, having a bore extending from said exterior surface of said cartridge into said chamber, and wherein said means for forming a substantially fluid-tight seal between said unitary means and each of said means for piping ink is a plurality of sleeving means, each adapted to fit over one each of each said tubular pipe devices, for coupling the supply of ink within one of each of said reservoirs to a respective tubular pipe bore and providing a substantially fluid-tight seal between each of said sleeving means and a respectively fitted tubular pipe device except through said bore.

2. The apparatus as set forth in claim 1, further comprising:

said cartridge and said frame are formed of injection molded plastics.

3. The apparatus as set forth in claim 2, further comprising:

the plastic used to mold said framing means has a degree of post-molding shrinkage such that each of said sleeving means is shrink fit to a respective tubular pipe device surrounded thereby.

4. An ink delivery system for an ink cartridge adapted for use with a printhead device., said cartridge having an interior surface, and exterior surface, and an interior chamber incorporating a plurality of ink reservoirs located within said chamber and one ink outflow port for each of said reservoirs, comprising:

channeling means, unitary with said cartridge, having a plurality of bores therethrough extending inwardly from each of said ink outflow ports to a separate ink inlet port within said chamber, respectively, for allowing ink stored within each of said reservoirs to be channeled separately from each of said reservoirs to said exterior surface of said cartridge via each of said outflow ports, respectively; and a unitary means, within said chamber, for forming at least sidewalls of each of said reservoirs, having means for sealingly coupling each of said reservoirs to only one of each of said channeling means, respectively, such that said unitary means prevents mixing of inks between said reservoirs while allowing outflow of ink from a reservoir through one of said channeling means, wherein said channeling means further comprises one, tubular cross-sectioned, ink pipe for each of said reservoirs, located proximate each other in an area of said interior surface of said cartridge adjacent an area of said exterior surface adapted for mounting printhead devices thereon in fluid communication with each of said outflow ports, and wherein said unitary means further comprises a reservoir frame, fitting within said chamber and having a predetermined shape and size such that ink reservoir volumes may be maximized, and having apertures therethrough for each of said reservoirs aligned with said channeling means, and a plurality of sleeves depending from said reservoir frame, each of said sleeves aligned with an aperture in said reservoir frame, located and adapted to receive one ink pipe each within each of said sleeves such that each of said apertures is further aligned with one of said inlet ports.

5. The system as set forth in claim 4, further comprising:

each of said sleeves is adapted to be shrinkable about said ink pipes.

6. The system as set forth in claim 4, further comprising:

cartridge snout means, having a substantially fluid-tight weld to said cartridge to encompass said outflow ports, for receiving ink from each of said outflow ports, and having an individual through channel for each of said outflow ports aligned therewith, for delivering ink to said printhead device; and ink filtering means, within said cartridge snout means, downstream of said weld and upstream of said printhead, for maintaining ink flow to said printhead substantially free of contaminants or air bubbles.

7. An ink cartridge device for a ink-jet pen adapted for use with an ink jet printhead device and having a plurality of ink reservoirs within a containment chamber having one ink outflow port for each of said reservoirs, comprising:

a plastic cartridge housing;

flaming means, within said chamber, for forming ink reservoir walls, said flaming means having piping means, one for each of said ink outflow ports, extending individually through each of said ink outflow ports of said cartridge, for piping ink from each of said reservoirs to said printhead device, including a reservoir frame, constructed of a plastic having a lower melting point temperature than the cartridge housing plastic, within the interior of said cartridge housing; and means for filtering ink downstream of said piping means from each of said reservoirs, wherein said means for filtering ink further includes a snout device, mounted upon said cartridge housing and adapted to have said printhead device mounted upon an external surface of said snout device distal from said cartridge housing, said snout device having separate apertures therethrough in fluid communication with each of said piping means, respectively, and filter screens mounted within each of said separate apertures, whereby ink from each of said reservoirs is piped without mixing with ink from another reservoir through individual piping means into an individual snout device aperture and through an individual filter screen before reaching said printhead device.

* * * * *